US006213788B1

(12) United States Patent
Murakami

(10) Patent No.: US 6,213,788 B1
(45) **Date of Patent: *Apr. 10, 2001**

(54) ELECTRICAL CONNECTION BOX

(75) Inventor: Masakazu Murakami, Hikone (JP)

(73) Assignee: The Furukawa Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/393,739

(22) Filed: Sep. 10, 1999

(30) Foreign Application Priority Data

Sep. 18, 1996 (JP) ..... 10-265021

(51) Int. Cl.[7] ..... H01R 4/58
(52) U.S. Cl. ..... 439/76.2
(58) Field of Search ..... 439/76.2, 76.1, 439/949, 67, 77, 210, 211, 212, 213; 361/624, 622

(56) References Cited

U.S. PATENT DOCUMENTS

| | | | | |
|---|---|---|---|---|
| 4,255,004 | * | 3/1981 | Kourimsky et al. | 439/76.2 |
| 4,684,765 | * | 8/1987 | Beck et al. | 439/76.2 |
| 4,850,884 | * | 7/1989 | Sawai et al. | 439/76.2 |
| 5,715,135 | * | 2/1998 | Brussalis et al. | 439/76.2 |
| 5,928,004 | * | 7/1999 | Sumida et al. | 439/76.2 |

* cited by examiner

*Primary Examiner*—Gary F. Paumen
*Assistant Examiner*—Ross Gushi
(74) *Attorney, Agent, or Firm*—Frishauf, Holtz, Goodman, Langer & Chick, P.C.

(57) ABSTRACT

An electrical connection box has a first casing and a second casing combined together, with a busbar, an insulating plate, and an electrically insulating wiring board between the casings, and mounted with electrical components. The second casing is formed with an extension extending sideways at right angles to the thickness direction of the second casing, and a control unit is provided on the extension.

9 Claims, 2 Drawing Sheets

ELECTRICAL CONNECTION BOX

BACKGROUND OF THE INVENTION

1. Field of the Invention

The present invention relates to an electrical connection box adapted to be mounted in an automobile.

2. Description of the Related Art

An electrical connection box that serves to simplify the arrangement of complicated electric circuits of an automobile comprises upper and lower casings, which are combined together with busbars and a wiring board between them. The electrical connection box is loaded with electrical components, such as relays, fuses, connectors, diodes, control unit, PTC (positive temperature coefficient) thermistor, etc.

Some electrical connection boxes of this type are formed integrally with the control unit that is used to control electrical appointments in the automobile. Conventionally, the control unit is located on the upper or lower surface of the electrical connection box so that it can be easily connected to terminals that extend from the casings of the box.

Modern automobiles are designed to enjoy minimized external dimensions and as wide an inside space as possible, so that room for the electrical connection box is gradually becoming narrower. Thus, in order to secure good room in the automobile, the electrical connection box is expected to be minimized in thickness, and therefore, in size. In the case of the electrical connection box that is provided with the control unit, in particular, the control unit is located on the upper or lower surface of the box, so that downsizing in the thickness direction is a vital necessity.

On the other hand, the wiring board has a large number of laying grooves on its obverse or reverse side, and a wire is laid in a desired shape for each circuit in these grooves. After the wire is laid by using an existing automatic wiring machine, its trailer is cut by means of a cutter as a fitting. Surpluses of the wire laid on the wiring board are cut separately by means of the cutter, and terminals and the like are connected to the wire before use. In the conventional electrical connection box, the waste surpluses of the cut wire are left on the wiring board.

In assembling the conventional electrical connection box, therefore, the surpluses of the wire remaining on the wiring board may possibly interfere with any of the busbars, and it is very laborious to remove them manually one after another.

SUMMARY OF THE INVENTION

A first object: of the present invention is to provide an electrical connection box capable of being reduced in thickness despite the use of a control unit.

A second object of the invention is to provide an electrical connection box in which waste surpluses of a wire laid on a wiring board can be removed with ease.

In order to achieve the first object, an electrical connection box in a first aspect of the present invention comprises a first casing and a second casing combined together, with a busbar, an insulating plate, and an electrically insulating wiring board between the casings, and mounted with electrical components, and is characterized in that the second casing is formed with an extension extending sideways at right angles to the thickness direction thereof and having a control unit thereon.

The thickness of the electrical connection box described above can be reduced despite the presence of the control unit.

In order to achieve the second object, an electrical connection box in a second aspect of the invention comprises a first casing and a second casing combined together, with a busbar, an insulating plate, and a wiring board with a large number of laying grooves between the casings, and mounted with electrical components, and is characterized in that the wiring board is provided with ejection holes penetrating the laying grooves in the thickness direction of the wiring board.

According to the electrical connection box described above, waste surpluses of a wire laid on the wiring board can be removed with ease.

Preferably, the control unit is an electronic control unit.

Preferably, moreover, the first and second casings are provided, on suitable spots thereof, with loading portions carrying the electrical components thereon.

Preferably, furthermore, the first and second casings, the insulating plate, and the wiring board are molded from a synthetic resin.

Preferably, the insulating plate is formed with a housing.

Preferably, moreover, the wiring board is formed, on both surfaces thereof, with a large number of laying grooves in desired shapes for wires.

The above and other objects, features, and advantages of the invention will be more apparent from the ensuing detailed description taken in connection with the accompanying drawings.

DETAILED DESCRIPTION OF THE PREFERRED EMBODIMENTS

Figure 2:
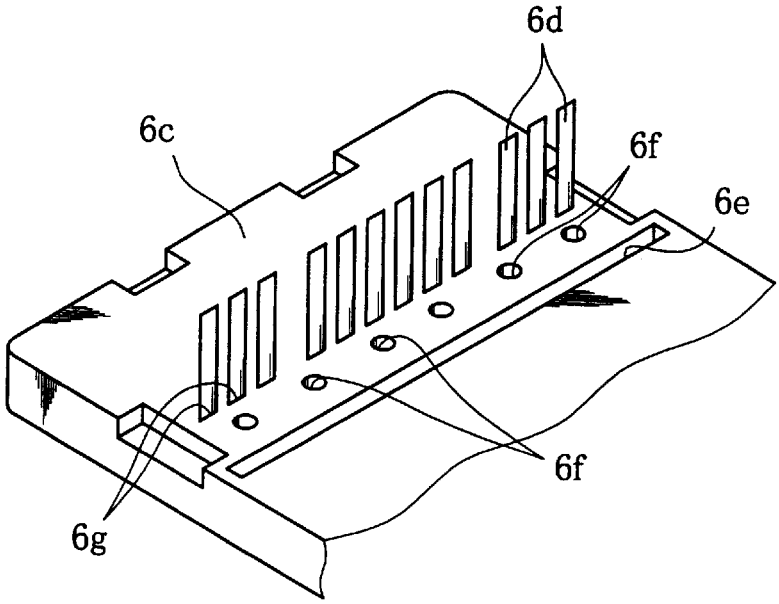
FIG. 2 is a perspective view of an extension formed on a lower casing.
Figure 3:
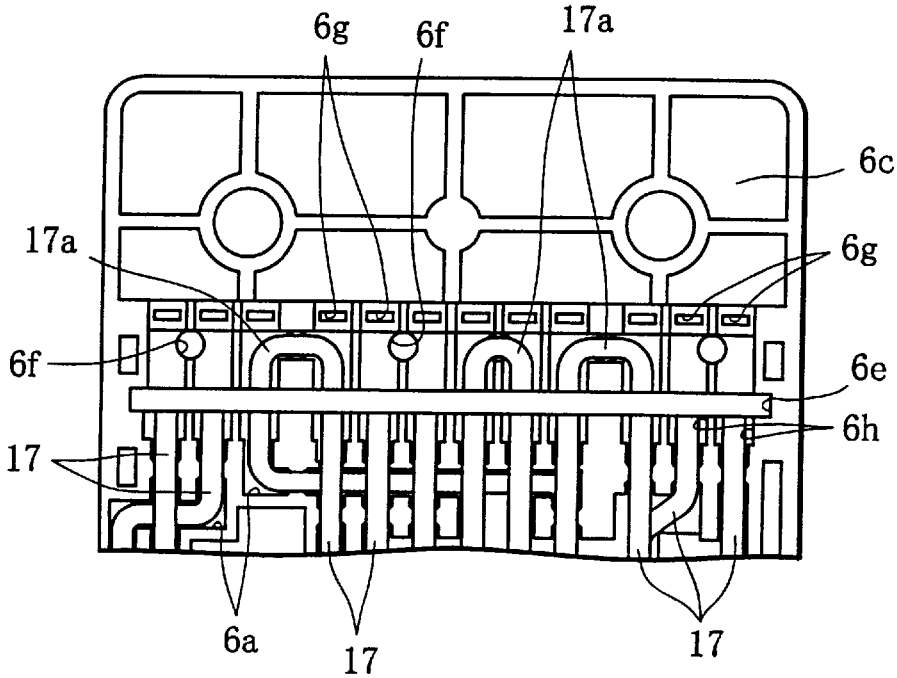
FIG. 3 is a rear view showing the backside of the extension of FIG. 2.

An electrical connection box according to a first embodiment to achieve the first object of the present invention will now be described in detail with reference to the accompanying drawings of FIGS. 1 to 3.

Figure 1:
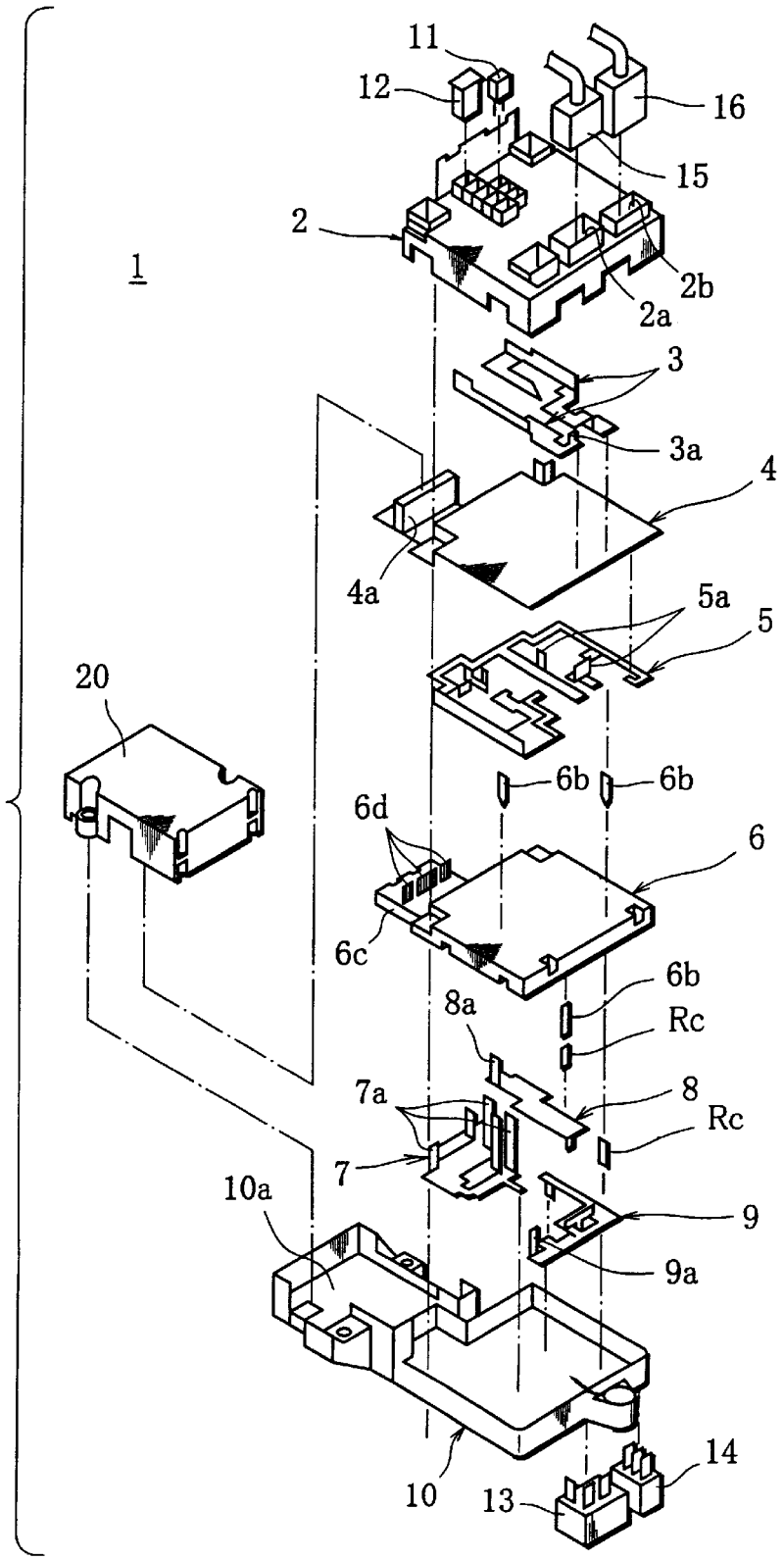
FIG. 1 is an exploded perspective view showing an arrangement of an electrical connection box according to the present invention.

As shown in FIG. 1, an electrical connection box 1 comprises an upper casing 2 and a lower casing 10, which are combined together with a busbar 3, insulating plate 4, busbar 5, wiring board 6, and busbars 7, 8 and 9 between them. It is mounted with various electrical components of different heights, including a mini-fuse 11, medium-current fuse 12, relays 13 and 14, connectors 15 and 16, etc.

The upper casing 2, insulating plate 4, wiring board 6, and lower casing 10 are molded in desired shapes from a synthetic resin, such as polypropylene (PP), nylon, or a polymer alloy based on these resins.

The upper and lower casings 2 and 10 are provided, on their suitable spots, with loading portions 2*a* and 2*b*, etc. that carry thereon the various electrical components including the fuses 11 and 12, relays 13 and 14, connectors 15 and 16, etc.

The lower casing 10 is formed integrally with an extension 10*a* that extends sideways at right angles to the thickness direction thereof. The extension 10*a* is provided with a control unit 20.

The control unit 20 is an electronic control unit (ECU) for controlling electrical appointments that are connected by means of the electrical connection box 1. As shown in FIG. 1, the unit 20 is fitted onto a housing 4*a* from above the insulating plate 4 and fixed to the extension 10*a*.

The busbars 3, 5, 7, 8 and 9 are obtained by molding an electrically conductive metal plate of brass, pure copper, or copper alloy into a desired wiring shape. Connecting terminals or tabs 3*a*, 5*a*, 7*a*, 8*a* and 9*a* are arranged at right angles to the plate surface in desired positions on their corresponding busbars.

The insulating plate 4 is formed with a large number of through holes (not shown) that are penetrated by the terminals 5*a* of the busbar 5. The housing 4*a* is provided on one side of the plate 4.

A large number of laying grooves 6*a* (see FIG. 3) are formed on the upper and lower surfaces of the wiring board 6, and wires 17 are laid in desired shapes in the grooves 6*a*, individually. Both upper and lower surfaces of the wiring board 6 are fitted with pressure connection terminals 6*b* and tabs (not shown), which are connected individually to desired ones of the wires 17 (see FIG. 3). Further, the board 6 is formed with a large number of through holes (not shown) that are penetrated by the terminals 7*a* to 9*a* of the busbars 7 to 9. As shown in FIGS. 1 and 2, moreover, the wiring board 6 is formed integrally with an extension 6*c* that extends sideways. A plurality of tabs 6*d*, each having one end connected to each corresponding wire 17 on the lower surface of the wiring board 6, protrude from the upper surface of the extension 6*c*. As shown in FIGS. 2 and 3, the extension 6*c* has a crosswise slit 6*e* that extends across the laying grooves 6*a* near the tabs 6*d*. A plurality of ejection holes 6*f* penetrate those portions of the laying grooves 6*a* between the slit 6*e* and the tabs 6*d* in the thickness direction. On the back side of the extension 6*c*, as shown in FIG. 3, moreover, passage holes 6*g* are formed near the ejection holes 6*f*, while mounting portions 6*h* are formed in those portions of the laying grooves 6*a* which are situated on the opposite side of the ejection holes 6*f* from the slit 6*e*.

In FIG. 1, symbol Rc denotes a receptacle terminal.

In the electrical connection box 1 of the invention constructed in this manner, the wires 17 are laid in desired shapes in the laying grooves 6*a* of the wiring board 6, and the upper and lower casings 2 and 10 are combined together with the busbar 3, insulating plate 4, busbar 5, wiring board 6, and busbars 7 to 9 between them. The box 1 is mounted with the various electrical components of different heights, including the mini-fuse 11, medium-current fuse 12, relays 13 and 14, connectors 15 and 16, etc.

In the electrical connection box 1, as shown in FIG. 1, the tabs 6*d* are passed through the housing 4*a* of the insulating plate 4 and connected to the control unit 20. Since the control unit 20 is located lateral to the electrical connection box 1, and not on the upper or lower surface thereof, the thickness of the box 1 can be considerably reduced by a margin corresponding to the thickness of the unit 20.

The wiring board 6 is assembled in a manner such that one end of each tab 6*d* is attached to each corresponding mounting portion 6*h* and connected to each corresponding wire 17 and the other end passed through each corresponding passage hole 6*g*.

According to the embodiment described above, the wiring board 6 is formed integrally with the extension 6*c*. Alternatively, however, the extension 6*c* may be a laminated structure formed of a busbar and an insulating plate.

The control unit 20 is located lateral to the electrical connection box 1, and the wires 17 are previously laid in desired shapes in the laying grooves 6*a* on the upper and lower surfaces of the wiring board 6. As shown in FIG. 3, therefore, the wires 17 are laid extending to the side of the extension 6*c* of the wiring board 6, and surpluses 17*a* inevitably remain on the other side of the slit 6*e* after the wires 17 are cut.

However, the surpluses 17*a* can be easily removed from the laying grooves 6*a* by pushing pins or the like individually into the ejection holes 6*f* of the wiring board 6 from above. Thus, in the electrical connection box 1, the surpluses 17*a* can be discharged very easily from the laying grooves 6*a* to achieve the second embodiment of the invention.

What is claimed is:

1. An electrical connection box comprising:

a first casing and a second casing combined together, and a busbar, an insulating plate, and an electrically insulating wiring board provided between the first and second casings, wherein the electrical connection box is mounted with electrical components, wherein the second casing has an extension extending sideways at a right angle to a thickness direction of the second casing, and a control unit is provided on the extension, wherein said wiring board is formed, on both surfaces thereof, with a plurality of laying grooves in which wires are laid, and said wiring board comprises a lateral extension having tabs provided thereon which are coupled to respective ones of said laid wires, and wherein said insulating plate is formed with a lateral housing through which the control unit is coupled to the tabs provided on the wiring board.

2. The electrical connection box according to claim 1, wherein all of said first and second casings, said insulating plate, and said wiring board are molded from a synthetic resin.

3. The electrical connection box according to claim 1, wherein said wiring board is provided with ejection holes that penetrate the laying grooves in a thickness direction of the wiring board, said ejection holes being adapted to enable unnecessary wires to be removed from said electrical connection box.

4. The electrical connection box according to claim 1, wherein loading portions that carry the electrical components are provided on said first and second casings.

5. The electrical connection box according to claim 4, wherein all of said first and second casings, said insulating plate, and said wiring board are molded from a synthetic resin.

6. The electrical connection box according to claim 1, wherein said control unit comprises an electronic control unit.

7. The electrical connection box according to claim 6, wherein all of said first and second casings, said insulating plate, and said wiring board are molded from a synthetic resin.

8. The electrical connection box according to claim 6, wherein loading portions that carry the electrical components are provided on said first and second casings.

9. The electrical connection box according to claim 8, wherein all of said first and second casings, said insulating plate, and said wiring board are molded from a synthetic resin.

* * * * *

UNITED STATES PATENT AND TRADEMARK OFFICE

CERTIFICATE OF CORRECTION

PATENT NO. : 6,213,788 B1
DATED : April 10, 2001
INVENTOR(S) : Masakazu Murakami It is certified that error appears in the above-identified patent and that said Letters Patent is hereby corrected as shown below:

Title page,
Item [30], Foreign Application Priority Data, change "Sep. 18, 1996" to -- Sep. 18, 1998 --.

Signed and Sealed this

Eighth Day of January, 2002

*Attest:*

*Attesting Officer*

JAMES E. ROGAN
*Director of the United States Patent and Trademark Office*